US011758944B2

(12) United States Patent
Chen et al.

(10) Patent No.: US 11,758,944 B2
(45) Date of Patent: Sep. 19, 2023

(54) HEATING WIRE AND ELECTRONIC ATOMIZING DEVICE HAVING THE SAME

(71) Applicant: SHENZHEN VERDEWELL TECHNOLOGY LIMITED, Shenzhen (CN)

(72) Inventors: Shouhao Chen, Shenzhen (CN); Zhiyong Ke, Shenzhen (CN)

(73) Assignee: SHENZHEN VERDEWELL TECHNOLOGY LIMITED, Shenzhen (CN)

( * ) Notice: Subject to any disclaimer, the term of this patent is extended or adjusted under 35 U.S.C. 154(b) by 574 days.

(21) Appl. No.: 16/748,963

(22) Filed: Jan. 22, 2020

(65) Prior Publication Data

US 2020/0229498 A1 Jul. 23, 2020

(30) Foreign Application Priority Data

Jan. 23, 2019 (CN) ..... 201910063034.8

(51) Int. Cl.
*A24F 40/46* (2020.01)
*H05B 1/02* (2006.01)
*H05B 3/46* (2006.01)

(52) U.S. Cl.
CPC ..... *A24F 40/46* (2020.01); *H05B 1/0244* (2013.01); *H05B 3/46* (2013.01); *H05B 2203/014* (2013.01); *H05B 2203/021* (2013.01)

(58) Field of Classification Search
CPC ..... A24F 40/46; H05B 1/0244; H05B 3/42; H05B 3/26; H05B 3/46; H05B 1/0266; H05B 1/0294
See application file for complete search history.

(56) References Cited

U.S. PATENT DOCUMENTS 3,819,903 A * 6/1974 Frick ..... H05B 3/76 338/297
2014/0314397 A1* 10/2014 Alima ..... A24F 40/46 392/386
2016/0309786 A1* 10/2016 Holtz ..... F22B 1/284
2016/0345632 A1* 12/2016 Lipowicz ..... H05B 3/16
(Continued)

FOREIGN PATENT DOCUMENTS

CN 2067377 U 12/1990
CN 2246979 Y 2/1997
(Continued)

OTHER PUBLICATIONS

First Office Action for Chinese Application No. 201910063034.8 dated Aug. 3, 2023.

*Primary Examiner* — Erin McGrath
(74) *Attorney, Agent, or Firm* — Dorsey & Whitney LLP

(57) ABSTRACT

A heating wire of an electronic atomizing device includes a central end, a distal end, and a plurality of spiral heating coils extending between the central end and the distal end. The plurality of spiral heating coils is coplanar and surrounds the central end. A mounting gap is formed between any two adjacent spiral heating coils in an extending direction of a reference line connecting the center end and the distal end. The widths of the mounting gaps gradually decrease along the extending direction of the reference line away from the central end. An electronic atomizing device including the aforementioned heating wire is further provided.

4 Claims, 5 Drawing Sheets

(56) References Cited

U.S. PATENT DOCUMENTS

| | | | | |
|---|---|---|---|---|
| 2017/0347714 | A1* | 12/2017 | Metz | H05B 3/48 |
| 2018/0168225 | A1* | 6/2018 | Zinovik | A24F 40/70 |
| 2020/0391634 | A1* | 12/2020 | Furui | B60N 2/5685 |

FOREIGN PATENT DOCUMENTS

| | | | | | |
|---|---|---|---|---|---|
| CN | 2251049 | Y | | 4/1997 | |
| CN | 101742949 | A | | 6/2010 | |
| CN | 201663887 | U | | 12/2010 | |
| CN | 201947486 | U | | 8/2011 | |
| CN | 201948793 | U | | 8/2011 | |
| CN | 106687806 | A | | 5/2017 | |
| CN | 207940583 | U | | 10/2018 | |
| CN | 208403269 | U | * | 1/2019 | H05B 3/56 |
| TW | 433709 | U | | 5/2001 | |
| TW | M573513 | U | | 1/2019 | |

* cited by examiner

HEATING WIRE AND ELECTRONIC ATOMIZING DEVICE HAVING THE SAME

CROSS-REFERENCE TO RELATED APPLICATION

This application claims priority to Chinese Patent Application No. 201910063034.8, entitled "HEATING WIRE AND ELECTRONIC ATOMIZING DEVICE HAVING THE SAME" filed Jan. 23, 2019, the contents of which are expressly incorporated by reference herein in its entirety.

TECHNICAL FIELD

The present disclosure relates to electronic atomizing devices.

BACKGROUND

For an electronic atomizing device which heats solid tobacco paste to be atomized, a heating wire is generally used to heat a bowl in which the tobacco paste is stored. However, since the bowl of the conventional electronic atomizing device is heated unevenly and thus has an unevenly distributed temperature field at the bottom thereof, uneven heating of the tobacco paste is resulted, such that bubbles are easily generated from the tobacco paste, and explosion of the bubbles may cause the tobacco paste splash. Meanwhile, user's suction experience of the electronic atomizing device is ultimately affected as a part of the tobacco paste subjected to a high temperature is scorched and carbonized and the other part of the tobacco paste subjected to a low temperature is burned inadequately.

SUMMARY

According to various embodiments, a heating wire and an electronic atomizing device are provided.

A heating wire of an electronic atomizing device is providing, the heating wire including: a central end; a distal end; and a plurality of spiral heating coils extending between the central end and the distal end, the plurality of spiral heating coils being coplanar and surrounding the central end, wherein a mounting gap is formed between any two adjacent spiral heating coils in an extending direction of a reference line connecting the center end and the distal end, and the widths of the mounting gaps gradually decrease along the extending direction of the reference line away from the central end.

An electronic atomizing device is provided, including a heating wire, wherein the heating wire includes: a central end; a distal end; and a plurality of spiral heating coils extending between the central end and the distal end, the plurality of spiral heating coils being coplanar and surrounding the central end, wherein a mounting gap is formed between any two adjacent spiral heating coils in an extending direction of a reference line connecting the center end and the distal end, and the widths of the mounting gaps gradually decrease along the extending direction of the reference line away from the central end.

These and other objects, advantages, purposes and features will become apparent upon review of the following specification in conjunction with the drawings.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Figure 1:
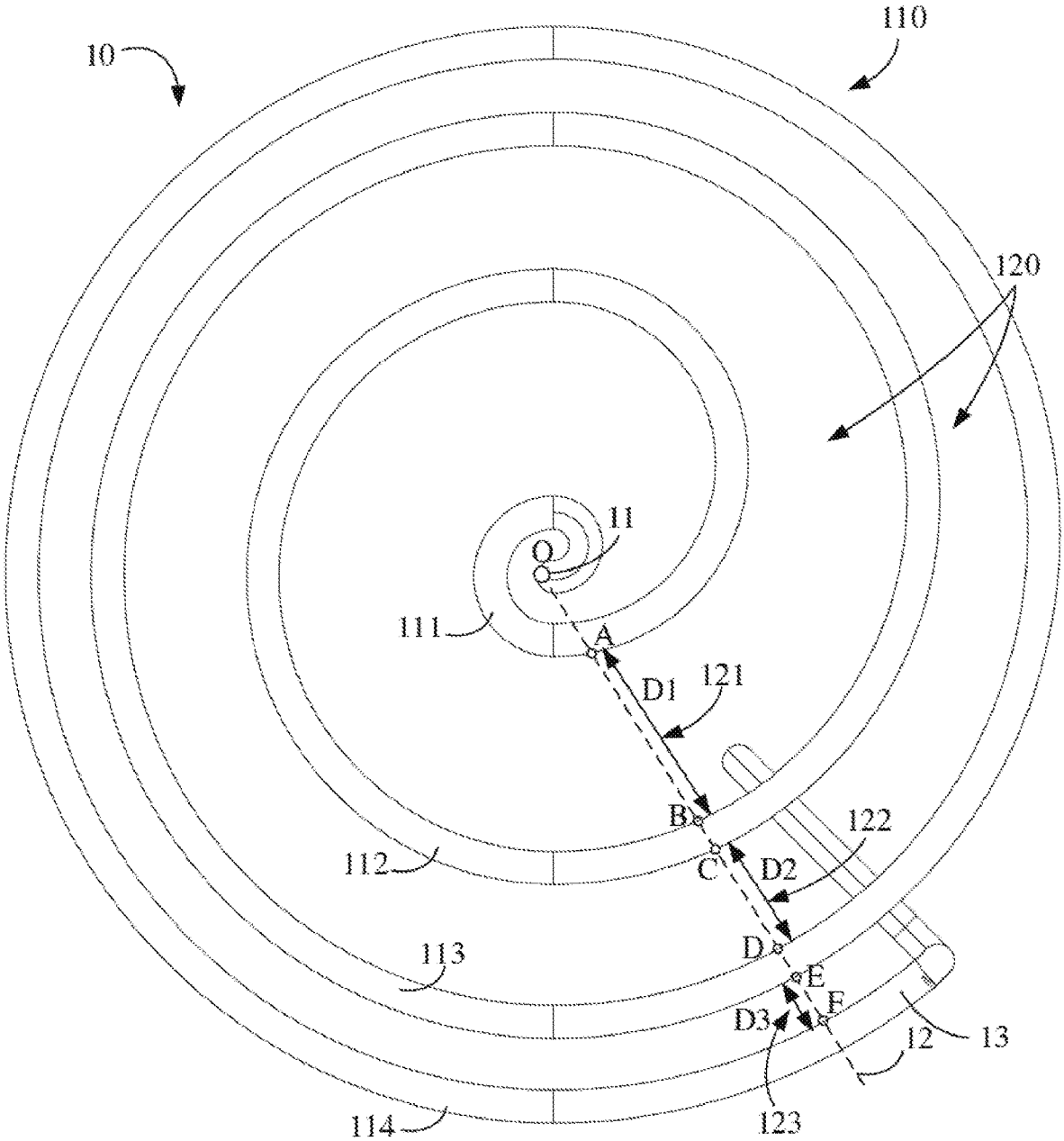
FIG. 1 is a plan view of a heating wire according to an embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Figure 4:
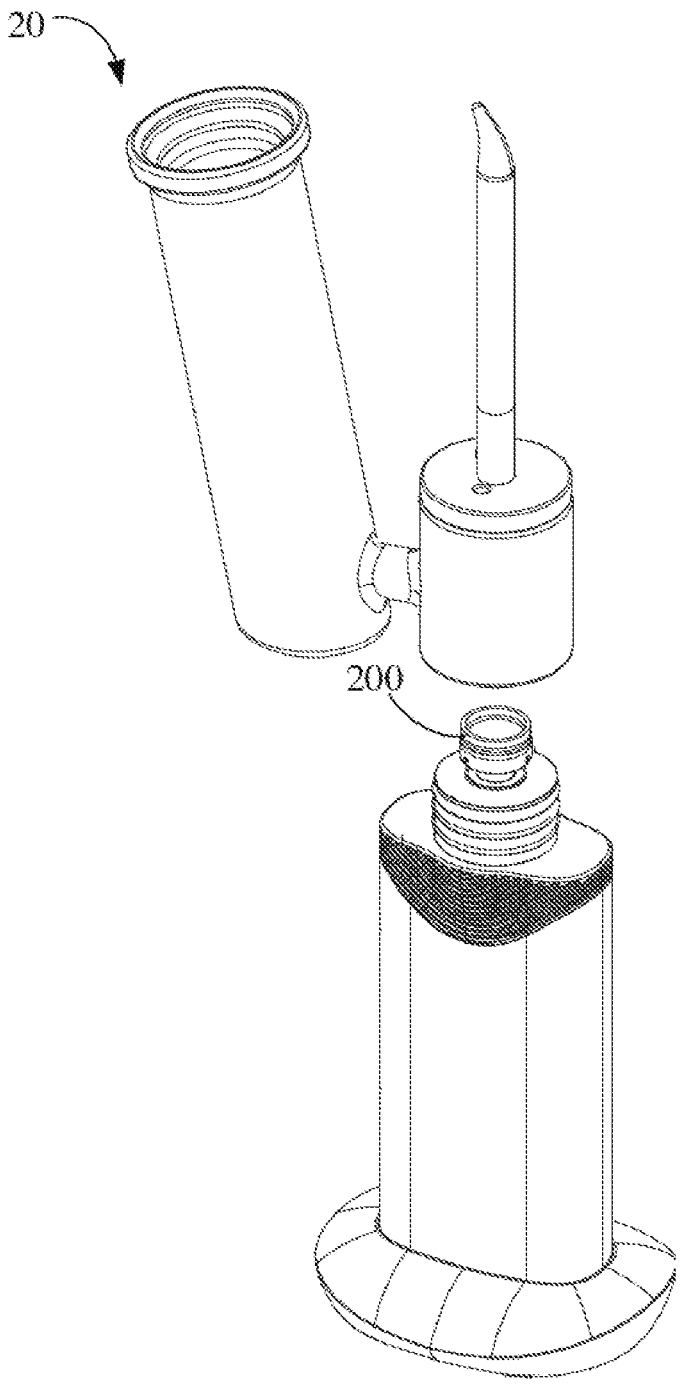
FIG. 4 is an exploded view of an electronic atomizing device according to an embodiment.
Figure 6:
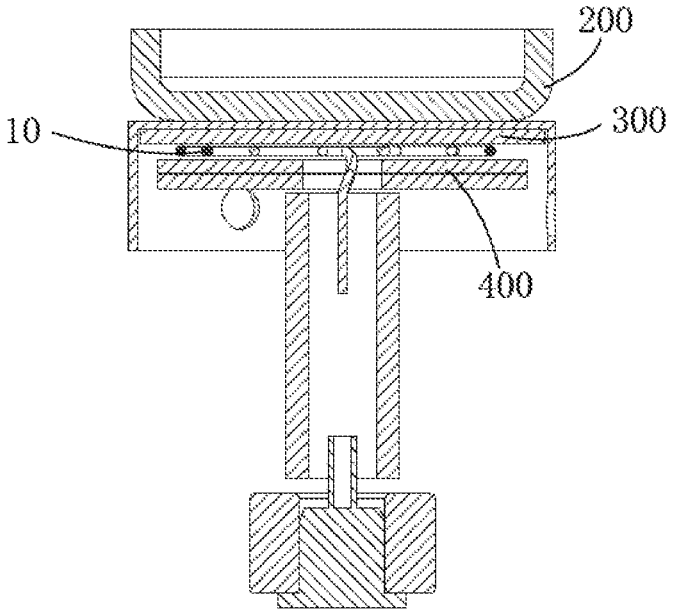
FIG. 6 is a cross-sectional view taken along line A-A of FIG. 5.

Referring to FIG. 1, FIG. 4, and FIG. 6, a heating wire 10 of an electronic atomizing device 20 is provided according to an embodiment. The heating wire 10 is used to heat a solid tobacco paste in a bowl 200. The heating wire 10 includes a central end 11, a distal end 13, and a plurality of spiral heating coils 110 extending between the central end 11 and the distal end 13. The plurality of spiral heating coils 110 are coplanar and surround the central end 11. The spiral heating coil 110 is shaped as a curve on a plane that winds around a fixed center point (e.g. the central end 11) at a continuously increasing distance from the point. Assuming there is a reference line 12 starting from the center end 11 and extending towards the distal end 13, then the reference line 12 intersects with each of the spiral heating coils 110 at multiply points. In the illustrated embodiment, at least three mounting gaps 120 are provided between any two adjacent spiral heating coils 110 in an extending direction of the reference line 12. The widths of the mounting gaps 120 gradually decrease along the extending direction of the reference line away from the central end 11. In other words, the mounting gap 120 between two adjacent spiral heating coils 110 located further from the central end 11 has a width smaller than that of the mounting gap 120 between two adjacent spiral heating coils 110 located closer to the central end 11.

Referring to FIG. 1, in the illustrated embodiment, the heating wire 10 has four spiral heating coils 110, i.e., a first heating coil 111, a second heating coil 112, a third heating coil 113, and a fourth heating coil 114, which are sequentially arranged from the inside out. The central end 11 is located at a center of the first heating coil 111. The reference line 12 starts from the central end 11 and intersects with the first heating coil 111 at point A, intersects with the second heating coil 112 at points B and C, intersects with the third heating coil 113 at points D and E, and intersects with the fourth heating coil 114 at point F in sequence.

A first mounting gap 121 is formed between the first heating coil 111 and the second heating coil 112 in the extending direction of the reference line 12 and has a width of $D_1$, which is the distance between the point A and the point B. A second mounting gap 122 is formed between the second heating coil 112 and the third heating coil 113 in the extending direction of the reference line 12 and has a width of $D_2$, which is the distance between the point C and the point D. A third mounting gap 123 is formed between the third heating coil 113 and the fourth heating coil 114 in the extending direction of the reference line 12 and has a width of $D_3$, which is the distance between the point E and the point F.

The heating coils of the conventional heating wire are arranged at equal intervals, in other words, intervals between two adjacent heating coils are constant from the central to the periphery of the heating wire. Since the heat generated by per unit length of the heating wire 10 is equal, temperature generated by such conventional heating wire might unevenly distributed as the periphery of the tobacco paste has a larger bulk than that of the central thereof and thus requires more heat to be atomized. By configuring the spiral heating coils 110 according to the aforementioned manner, the spiral heating coils 110 are densely arranged in the periphery, such that the temperature field generated by the spiral heating coils 110 is evenly distributed from the center to the periphery of the heating wire 10 comparing with the prior art. The bowl 200 is heated evenly by the heating wire 10, such that it can prevent the tobacco paste in the bowl 200 from splashing or explosion. In addition, it can avoid that scorched flavor is generated as the tobacco paste is scorched due to an over-heated temperature, and that concentration of the smoke generated from the atomized tobacco paste is lowered as the tobacco paste is burned inadequately due to a low temperature, such that the user's taste and suction experience is improved.

In some embodiments, when a diameter of the bowl 200 ranges from about 10 mm to about 18 mm, $D_1$ is equal to 1.3 to 1.8 times of $D_2$, and $D_1$ is equal to 3.5 to 4 times of $D_3$. In an embodiment, when the bowl 200 has a diameter of about 16 mm, $D_1=1.5D_2=3.8D_3$. In that case, the temperature field generated by the heating wire 10 is evenly distributed, such that the tobacco paste is heated evenly with a good atomization effect, and the energy waste of the heating wire 10 due to the locally high temperature is prevented, and a higher energy efficiency of the heating wire 10 is ensured.

Figure 3:
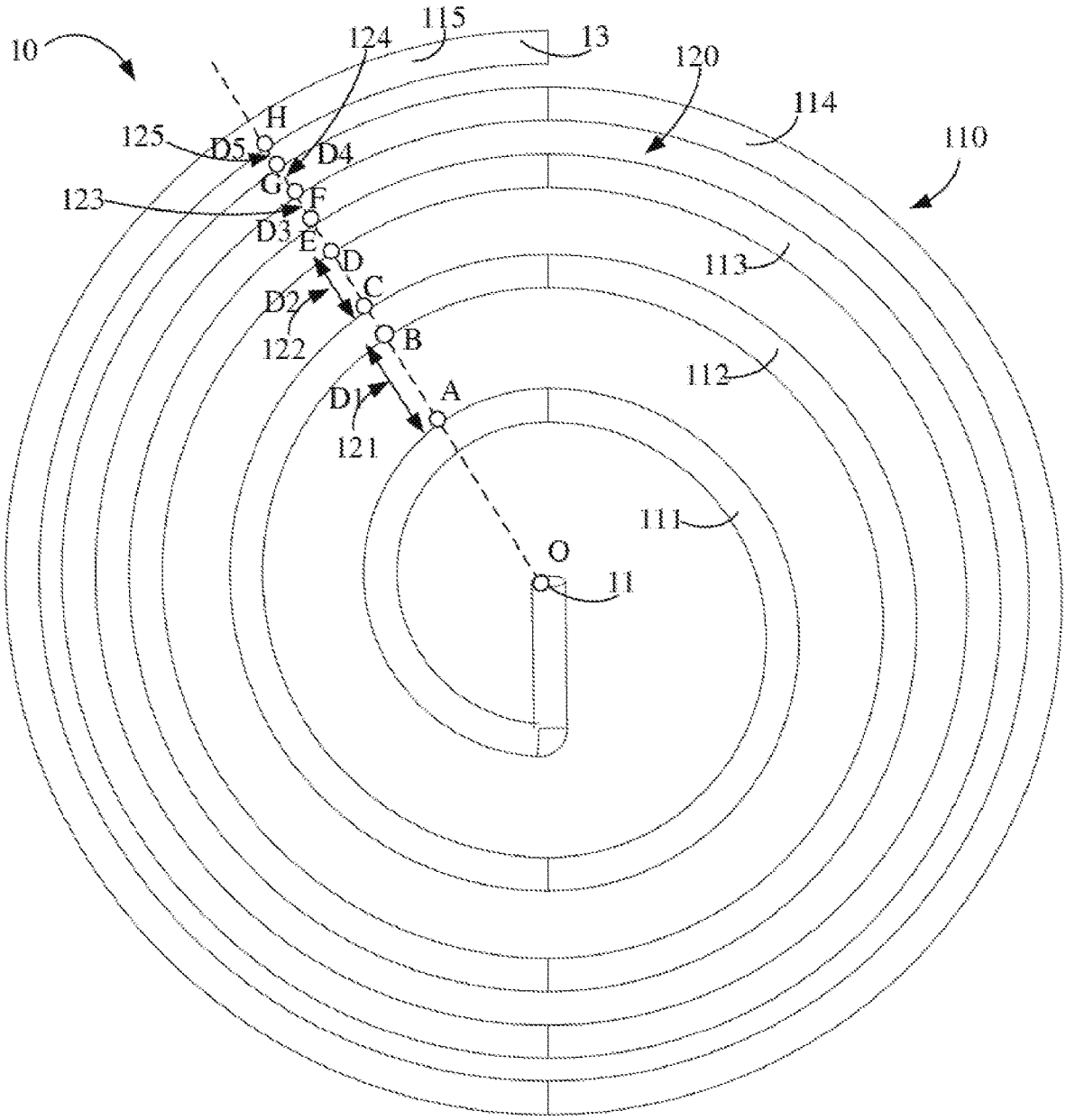
FIG. 3 is a plan view of a heating wire according to another embodiment.

Referring to FIG. 3, in the illustrated embodiment, the heating wire 10 has five spiral heating coils 110, i.e., a first heating coil 111, a second heating coil 112, a third heating coil 113, a fourth heating coil 114, and a fifth heating coil 115, which are sequentially arranged from the inside out. Similar to the embodiment illustrated in FIG. 1, the reference line 12 starts from the central end 11 and first intersects with the first heating coil 111 at point A, intersects with the second heating coil 112 at points B and C, intersects with the third heating coil 113 at points D and E, intersects with the fourth heating coil 114 at points F and G, and intersects with the fifth heating coil 115 at point H in sequence.

A first mounting gap 121 is formed between the first heating coil 111 and the second heating coil 112 in the extending direction of the reference line 12 and has a width of $D_1$, which is the distance between the point A and the point B. A second mounting gap 122 is formed between the second heating coil 112 and the third heating coil 113 in the extending direction of the reference line 12 and has a width of $D_2$, which is the distance between the point C and the point D. A third mounting gap 123 is formed between the third heating coil 113 and the fourth heating coil 114 in the extending direction of the reference line 12 and has a width of $D_3$, which is the distance between the point E and the point F. A forth mounting gap 124 is formed between the fourth heating coil 114 and the fifth heating coil 115 in the extending direction of the reference line 12 and has a width of $D_4$, which is the distance between the point G and the point H.

In some embodiments, when a diameter of the bowl 200 ranges from about 18 mm to about 25 mm, $D_1$ is equal to 1.2 to 1.5 times of $D_2$, and $D_1$ is equal to 2.2 to 3 times of $D_3$, and $D_1$ is equal to 4 to 6 times of $D_4$. In an embodiment, when the bowl 200 has a diameter of about 22 mm, $D_1=1.3D_2=2.5D_3=5D_4$. In that case, the temperature field generated by the heating wire 10 is evenly distributed, such that the tobacco paste is heated evenly with a good atomization effect, and the energy waste of the heating wire 10 due to the locally high temperature is prevented, and a higher energy efficiency of the heating wire 10 is ensured.

In some embodiments, the heating wire 10 is made of iron-chromium alloy or chromium-nickel alloy. The heating wire 10 made of such material has a better thermal conductivity and a higher melting point, and the heating speed to the bowl 200 and the tobacco paste and the service life of the whole heating wire 10 are improved.

Figure 2:
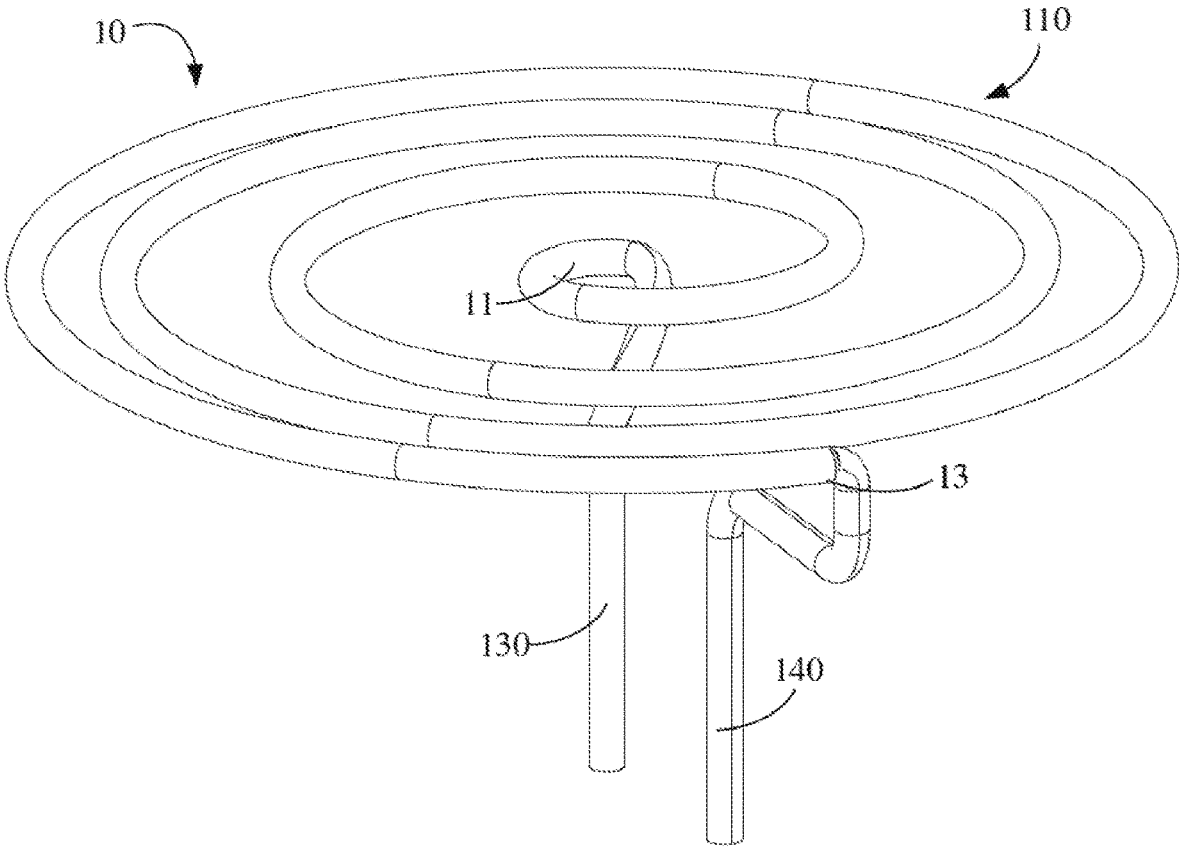
FIG. 2 is a perspective view of a heating wire of FIG. 1.

Referring to FIG. 2, the heating wire 10 further includes a first leading wire 130 and a second leading wire 140 configured to be coupled to a positive and a negative electrodes (not shown), respectively. The first leading wire 130 is connected to the central end 11, and the second leading wire 140 is connected to the distal end 13. The first leading wire 130 and the second leading wire 140 are both located at the same side of a plane where the spiral heating coils 110 are located. In other embodiments, the first leading wire 130 and the second leading wire 140 may be located at opposite sides of the plane, respectively.

In some embodiments, the heating wire 10 has a length corresponding to the size of the bowl 200. For example, the length of the heating wire 10 can be about 70 mm, about 90 mm, about 150 mm or about 180 mm. The length of the heating wire 10 merely refers to a sum of the lengths of the whole spiral heating coils 110, and does not include the lengths of the first leading wire 130 and the second leading wire 140.

In some embodiments, a resistance of the heating wire 10 ranges from about 0.2Ω to about 2Ω, and each of the spiral heating coils 110 has a cross-section with a diameter which ranges from about 0.25 mm to about 0.8 mm.

Figure 5:
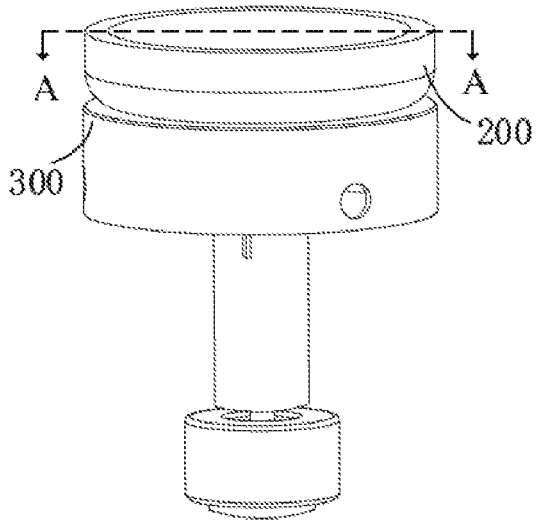
FIG. 5 is a perspective view of a bowl and an insulating sheet of FIG. 4.

Referring to FIGS. 4 to 6, an electronic atomizing device 20 is provided according to an embodiment, which includes the heating wire 10 according to any one of the aforementioned embodiments.

The electronic atomizing device 20 further includes the bowl 200 coaxially disposed with the heating wire 10. The bowl 200 has a diameter larger than or equal to the diameter of the heating wire 10, which ensures that the heat generated by the heating wire 10 is adequately transferred to the tobacco paste through the bowl 200, such that the energy efficiency of the heating wire 10 is improved. In some embodiments, a diameter of the bowl 200 ranges from about 10 mm to about 25 mm. For example, the diameter of the bowl 200 may be about 10 mm, about 16 mm, about 22 mm or about 25 mm.

The electronic atomizing device 20 further includes a heat insulating sheet 400 and an electric insulating sheet 300. The heat insulating sheet 400 may be made of mica. The electric insulating sheet 300 may be made of ceramic. The heat insulating sheet 400 and the electric insulating sheet 300 are disposed opposite to each other, and the spiral heating coils 110 are sandwiched between the heat insulating sheet 400 and the electric insulating sheet 300. The first leading wire 130 and the second leading wire 140 of the heating wire 10 may extend through the heat insulating sheet 400 to be coupled to the electrodes. The bowl 200 is in contact with the electric insulating sheet 300.

Since the electronic atomizing device 20 includes the aforementioned heating wire 10, a good atomizing effect is resulted from the tobacco paste heated evenly, which improves the user's taste and suction experience of the electronic atomizing device 20.

The foregoing respective technical features involved in the respective embodiments can be combined arbitrarily, for brevity, not all possible combinations of the respective technical features in the foregoing embodiments are described, however, to the extent they have no collision with each other, the combination of the respective technical features shall be considered to be within the scope of the description.

The foregoing implementations are merely specific the embodiment of the present disclosure, and are not intended to limit the protection scope of the present disclosure. It should be noted that any variation or replacement readily figured out by persons skilled in the art within the technical scope disclosed in the present disclosure shall all fall into the protection scope of the present disclosure. Therefore, the protection scope of the present disclosure shall be subject to the protection scope of the claims.

What is claimed is:

1. An electronic atomizing device, comprising:

a heating wire, wherein the heating wire comprises:

a central end;

a distal end; and a plurality of spiral heating coils extending between the central end and the distal end, the plurality of spiral heating coils being coplanar and surrounding the central end, wherein a mounting gap is formed between any two adjacent spiral heating coils of the plurality of spiral heating coils in an extending direction of a reference line connecting the center end and the distal end, and widths of the mounting gaps gradually decrease along the extending direction of the reference line away from the central end;

a bowl coaxially disposed with the heating wire, wherein a diameter the heating wire is less than or equal to a diameter of the bowl; and a heat insulating sheet and an electric insulating sheet opposite to each other, wherein the plurality of spiral heating coils are sandwiched between the heat insulating sheet and the electric insulating sheet, and the bowl is in contact with the electric insulating sheet;

wherein the plurality of spiral heating coils comprises a first heating coil, a second heating coil, a third heating coil and a fourth heating coil sequentially arranged from the inside out, a first mounting gap formed between the first heating coil and the second heating coil in the extending direction of the reference line has a width of $D_1$, a second mounting gap formed between the second heating coil and the third heating coil in the extending direction of the reference line has a width of $D_2$, a third mounting gap formed between the third heating coil and the forth heating coil in the extending direction of the reference line has a width of $D_3$, the bowl has a diameter of about 10 mm to about 18 mm, $D_1$ is equal to 1.3 to 1.8 times of $D_2$, and $D_1$ is equal to 3.5 to 4 times of $D_3$.

2. The electronic atomizing device of claim 1, wherein the heating wire further comprises a first leading wire and a second leading wire configured to be coupled to electrodes, respectively, the first leading wire is connected to the central end, and the second leading wire is connected to the distal end.

3. The electronic atomizing device of claim 2, wherein the first leading wire and the second leading wire are both located at the same side of a plane where the spiral heating coils are located.

4. The electronic atomizing device of claim 1, wherein the heating wire is made of iron-chromium alloy or chromium-nickel alloy.

* * * * *